US011097818B2

(12) United States Patent
Liao

(10) Patent No.: US 11,097,818 B2
(45) Date of Patent: Aug. 24, 2021

(54) DIVING MASKS

(71) Applicant: Dong Guan City Blue Dolphin Sporting Goods Co.,Ltd, Dongguan (CN)

(72) Inventor: Lixiang Liao, Dongguan (CN)

(73) Assignee: Dong Guan City Blue Dolphin Sporting Goods Co., Ltd, Dongguan (CN)

( * ) Notice: Subject to any disclaimer, the term of this patent is extended or adjusted under 35 U.S.C. 154(b) by 105 days.

(21) Appl. No.: 16/668,185

(22) Filed: Oct. 30, 2019

(65) Prior Publication Data

US 2020/0231260 A1 Jul. 23, 2020

(30) Foreign Application Priority Data

Jan. 17, 2019 (CN) ..... 201910044057.4
Jun. 5, 2019 (CN) ..... 201910484297.6

(51) Int. Cl.

| | |
|---|---|
| ***B63C 11/16*** | (2006.01) |
| ***B63C 11/14*** | (2006.01) |
| ***B63C 11/12*** | (2006.01) |
| ***B63C 11/20*** | (2006.01) |
| *A62B 9/02* | (2006.01) |
| *A62B 18/10* | (2006.01) |

(52) U.S. Cl.

CPC ..... *B63C 11/16* (2013.01); *B63C 11/12* (2013.01); *B63C 11/14* (2013.01); *B63C 11/205* (2013.01); *A62B 9/02* (2013.01); *A62B 18/10* (2013.01); *B63C 2011/128* (2013.01); *B63C 2011/165* (2013.01)

(58) Field of Classification Search

CPC .. A61M 16/20; A61M 16/208; A61M 16/209; B63C 11/00; B63C 11/02; B63C 11/12; B63C 11/16; B63C 11/18; B63C 11/20; B63C 11/205; B63C 11/207; B63C 11/14; B63C 11/184; B63C 11/202; B63C 2011/123; B63C 2011/125; B63C 2011/126; B63C 2011/128; B63C 2011/165; B63C 2011/182; A62B 7/00; A62B 9/00; A62B 9/02; A62B 18/00; A62B 18/003; A62B 18/02; A62B 18/025; A62B 18/04; A62B 18/045; A62B 18/08; A62B 18/082; A62B 18/10; A62B 18/084

See application file for complete search history.

(56) References Cited

U.S. PATENT DOCUMENTS 5,701,884 A * 12/1997 Fondas ..... B63C 11/205 128/200.24
6,478,024 B1 * 11/2002 White, Jr. ..... B63C 11/207 128/200.29

(Continued)

*Primary Examiner* — Colin W Stuart
(74) *Attorney, Agent, or Firm* — Andrew C. Cheng

(57) ABSTRACT

The disclosure relates to a diving mask, including: a mask having a breath cavity corresponding to a mouth and a nose of a user; a vent tube connected to the mask and provided with an inlet passage, the inlet passage communicating the breath cavity with external air; and an exhaust device communicating the breath cavity, the exhaust device including an exhaust fan configured to discharge air in the breath cavity into an external environment, thereby enabling the external air to flow into the breath cavity through the inlet passage.

19 Claims, 12 Drawing Sheets

(56) References Cited

U.S. PATENT DOCUMENTS

| | | | | |
|---|---|---|---|---|
| 2002/0117172 | A1* | 8/2002 | Chiang | B63C 11/207 128/201.27 |
| 2004/0007230 | A1* | 1/2004 | Liao | B63C 11/202 128/201.27 |
| 2007/0174952 | A1* | 8/2007 | Jacob | B63C 11/16 2/426 |
| 2010/0132701 | A1* | 6/2010 | Fukasawa | B63C 11/205 128/201.11 |
| 2011/0146675 | A1* | 6/2011 | Chen | B63C 11/205 128/201.11 |
| 2016/0251065 | A1* | 9/2016 | Lin | B63C 11/26 128/201.27 |
| 2016/0297505 | A1* | 10/2016 | Caprice | B63C 11/16 |
| 2016/0347432 | A1* | 12/2016 | Smith | B63C 11/202 |
| 2018/0362129 | A1* | 12/2018 | Colborn | B63C 11/202 |
| 2019/0023366 | A1* | 1/2019 | Liao | B63C 11/16 |
| 2019/0225312 | A1* | 7/2019 | Barone | B63C 11/16 |
| 2020/0001956 | A1* | 1/2020 | Gauthier | A62B 7/14 |

* cited by examiner

DIVING MASKS

CROSS-REFERENCE TO RELATED APPLICATION

This application claims the benefit of Chinese Patent Application No. 201910044057.4, titled "DIVING MASK", filed on Jan. 17, 2019 and Chinese Patent Application No. 201910484297.6, titled "DIVING MASK", filed on Jun. 5, 2019. The entireties of both applications are incorporated by reference herein for all purposes.

TECHNICAL FIELD

The present disclosure relates to diving masks.

BACKGROUND

At present, with people's demand for various sports, as an emerging sport, diving has become more and more popular. During diving, people wish to see scenery underwater. Thus, diving masks are often used.

However, when a person breathes under water with the diving mask, it is not easy to discharge exhaust gas continuously only by pressure of person's exhaled air, thereby easily causing a part of the exhaust gas to remain in airway. After a long time of diving, too much exhaust gas is left in the mask, which is easy to cause dioxide carbon poisoning of diving personnel, and exists a certain safety hazard.

SUMMARY

According to various embodiments, a diving mask is provided.

A diving mask includes a mask, a vent tube, and an exhaust device. The mask has a breath cavity corresponding to a mouth and a nose of a user. The vent tube is connected to the mask and provided with an inlet passage. The inlet passage communicates the breath cavity and external air. The exhaust device communicates the breath cavity. The exhaust device includes an exhaust fan configured to discharge air in the breath cavity into an external environment, thereby enabling the external air to flow into the breath cavity through the inlet passage.

A diving mask includes a mask, a vent tube, an exhaust device, a detection switch, and a second buoyant valve body. The mask has a breath cavity corresponding to a mouth and a nose of a user. The vent tube is connected to the mask and provided with an inlet passage. The exhaust device communicates the breath cavity and an external environment. The detection switch is electrically coupled to the exhaust device. The second buoyant valve body is accommodated in a second accommodation chamber. When the vent tube is located above a water surface, the second buoyant valve body moves away from the inlet hole due to gravity, and presses the detection switch to activate the exhaust device. When the vent tube is submerged into the water, the second buoyant valve body is raised by buoyancy and moves towards the inlet hole, the exhaust device is deactivated after the second buoyant valve body stops pressing the detection switch.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

In order to facilitate understanding of the disclosure, the disclosure will be described more fully below with reference to the accompanying drawings. Preferred embodiments of the present disclosure are shown in the accompanying drawings. However, the present disclosure can be implemented in many different forms and is not limited to the embodiments described herein. On the contrary, it is an object of these embodiments to provide a more thorough understanding of the disclosure of the present disclosure.

Unless otherwise defined, all technical and scientific terms used herein have the same meaning as generally understood by those skilled in the art of the present disclosure. The terms used herein in the specification of the disclosure are for the purpose of describing specific embodiments only and are not intended to limit the disclosure.

It should be noted that when an element is referred to as being "fixed" to another element, it can be directly on the other element or it can also be presence of a central element. When an element is considered to be "connected" to another element, the element can be directly connected to the other element or it can be simultaneous presence of the central element. The terms "vertical", "horizontal", "left", "right" and the like used herein are for illustrative purposes only and are not meant to be the only embodiment.

Figure 1:
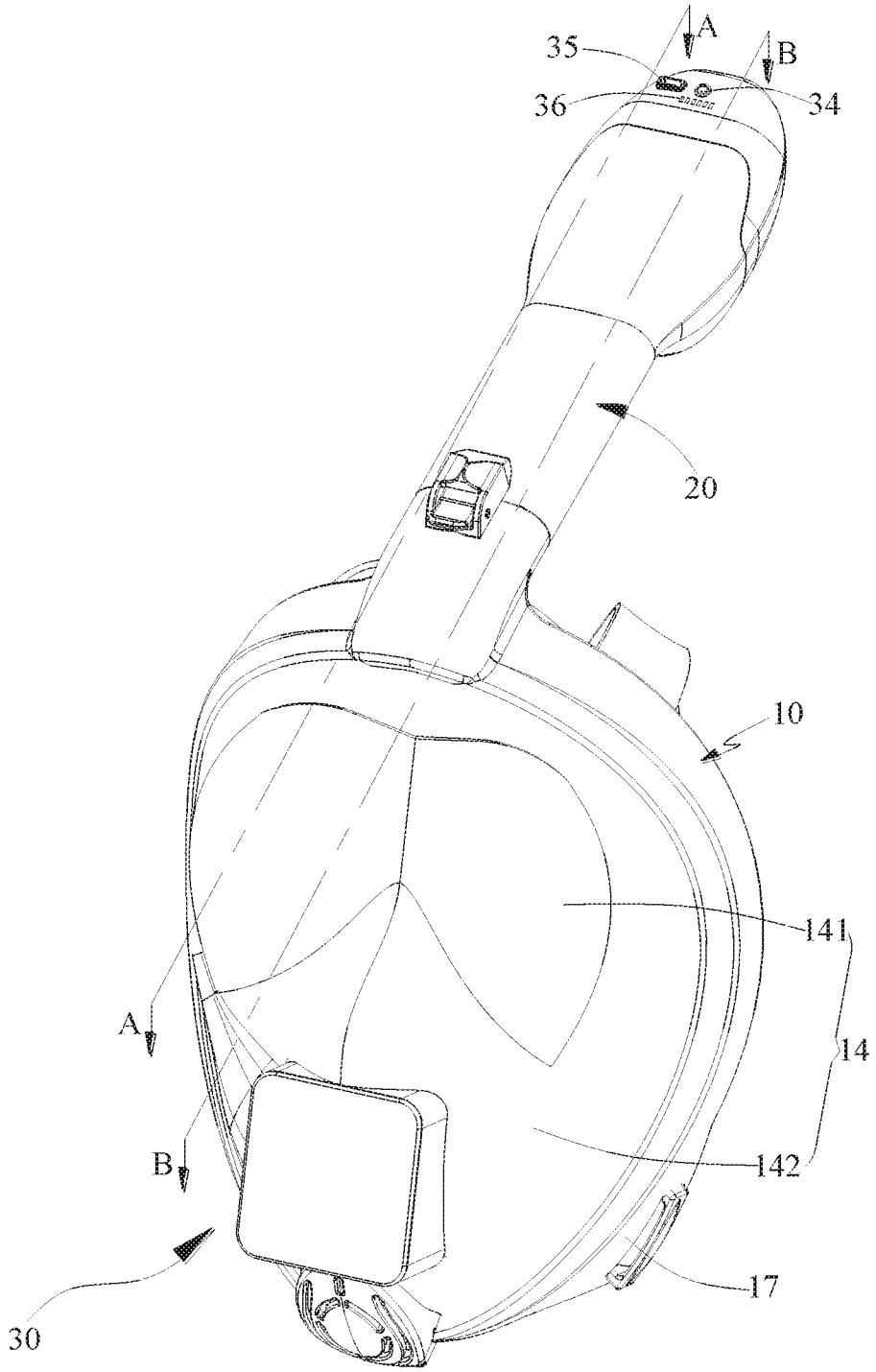
FIG. 1 is a perspective view of a diving mask according to a first embodiment.

Referring to FIG. 1, a diving mask of a first embodiment of the present disclosure includes a mask 10, a vent tube 20 connected to the mask 10, and an exhaust device 30 located on the mask 10.

Figure 2:
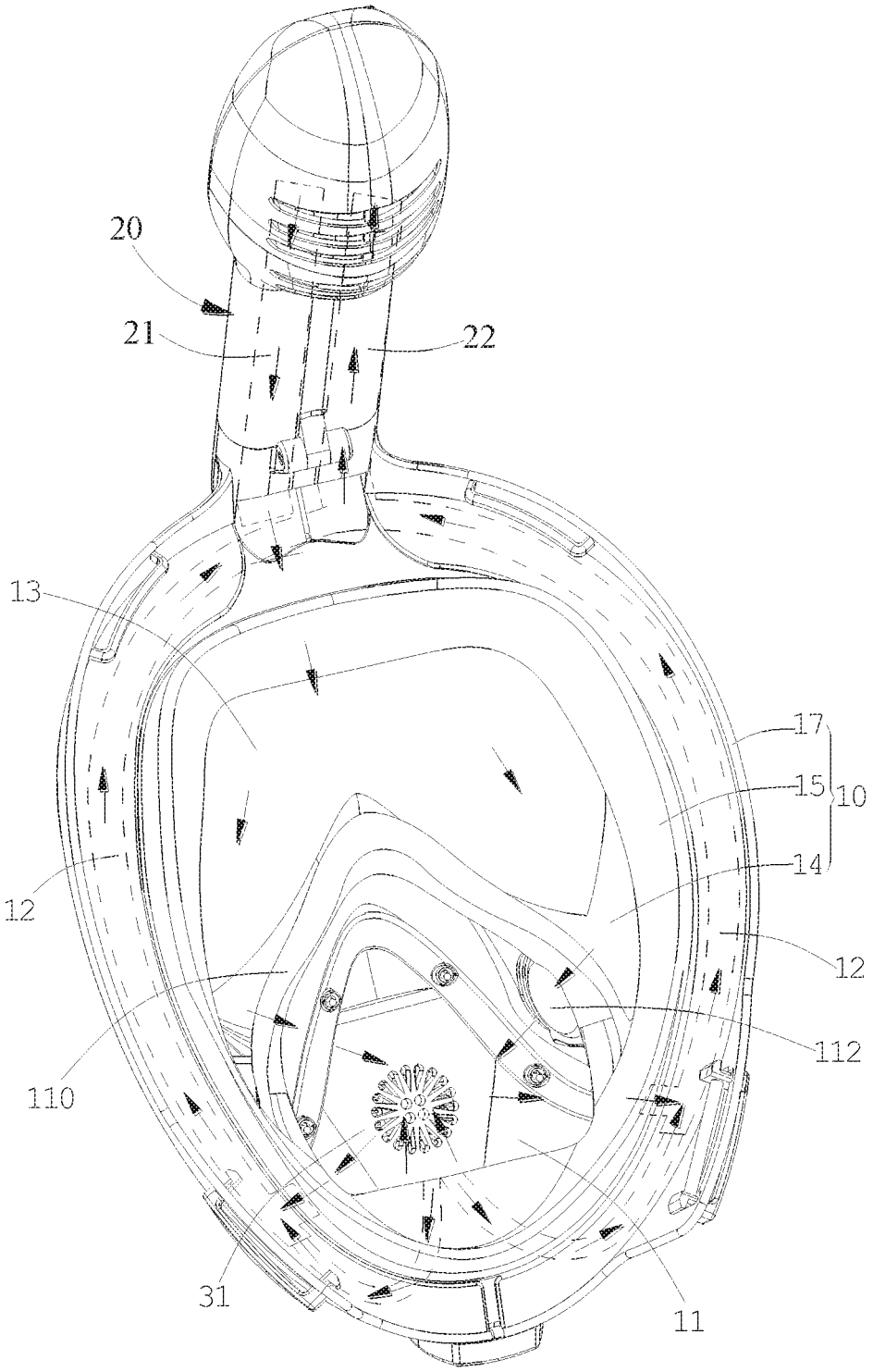
FIG. 2 is a perspective view of the diving mask of FIG. 1 viewed from another aspect after removing a strap.

Referring to FIG. 2, the mask 10 is provided with a breath cavity 11. The vent tube 20 is provided with an inlet passage 21 communicating the breath cavity 11 and an external environment. The exhaust device 30 includes an exhaust fan 31 communicating the breath cavity 11. The exhaust fan 31 is capable of discharging air in the breath cavity 11 into an external environment during working, thereby enabling an air circulation in which external air can flow into the breath cavity 11 through the inlet passage 21.

The flow direction of the airflow is indicated by the arrow shown in FIG. 2. When the mask 10 is used by a user for diving, such as snorkeling, the vent tube 20 can protrude from the water surface to allow a person to suck in external fresh air through the inlet passage 21. The exhaust fan 31 can discharge exhaust gas exhaled by the user in the breath cavity 11 to the external environment, and at the same time, the external fresh air is replenished into the breath cavity 11 through the inlet passage 21. Therefore, by providing the exhaust device 30, the mask 10 can effectively prevent the excessive accumulation of the exhaust gas remaining in the breath cavity 11, which may cause carbon dioxide poisoning to the user, thus ensuring the safety of the user. In addition, when the exhaust fan 31 discharges the exhaust gas in the breath cavity 11 to the external environment, a pressure difference is generated between the air pressure in the breath cavity 11 and the atmospheric pressure, therefore the external fresh air is forced to automatically flow into the breath cavity 11 through the inlet passage 21. By increasing the flow speed of the air in the breath cavity 11, the user can breathe more smoothly.

In one embodiment, referring to FIG. 2, the mask 10 is provided with a first exhaust passage 12 communicating the exhaust fan 31. The vent tube 20 is provided with a second exhaust passage 22 communicating the first exhaust passage 12 with the external environment. In the illustrated embodiment, in addition to communicating the breath cavity 11 through the exhaust fan 31, the first exhaust passage 12 is also communicated with the breath cavity 11 directly. Thus, when the exhaust device 30 stops working, the air exhaled into the breath cavity 11 by the user can flow directly from the breath cavity 11 into the first exhaust passage 12 and then be discharged to the external environment through the second exhaust passage 22. Further, a second check valve 120 is provided at a connection place between the first exhaust passage 12 and the breath cavity 11. The second check valve 120 only allows the air in the breath cavity 11 to flow into the first exhaust passage 12, while prevents the air of the first exhaust passage 12 from flowing back into the breath cavity 11, such that it can effectively prevent the exhaust gas flowing into the first exhaust passage 12 from flowing back to the breath cavity 11 for the user to breathe, and it can effectively reduce the concentration of carbon dioxide in the breath cavity 11 to ensure safety of the user effectively.

The first exhaust passage 12 is provided at a side of the mask 10. In the illustrated embodiment, two exhaust passages are respectively provided at opposite sides of the mask 10. The two exhaust passages are beneficial for increasing the exhaust gas amount and can further improve breath smoothness of the user.

Figure 5:
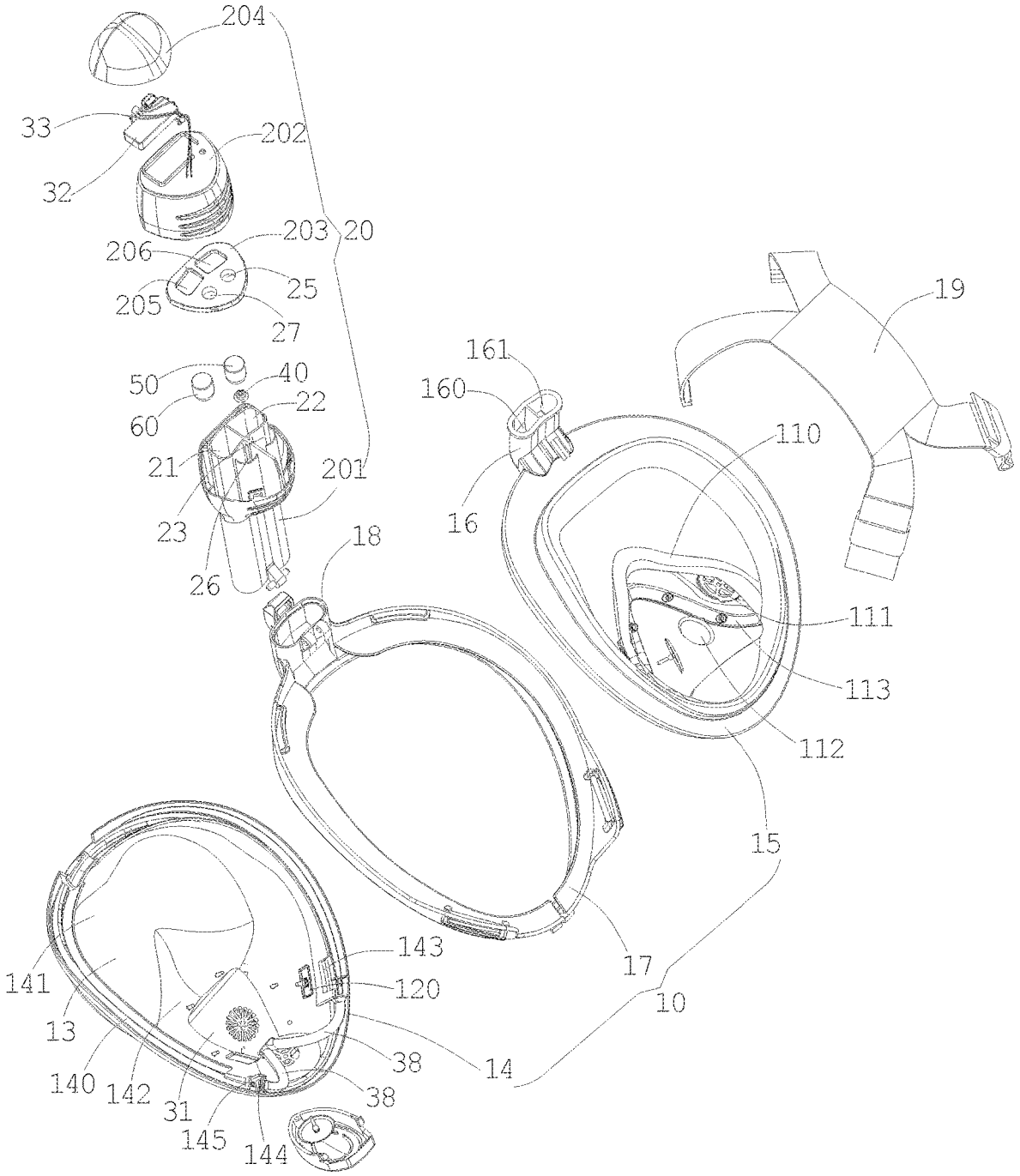
FIG. 5 is an exploded perspective view of the diving mask of FIG. 2.

Referring to FIGS. 2 and 5, the mask 10 further includes an observation chamber 13 located between the inlet passage 21 and the breath cavity 11. When the mask 10 is worn on the face of the diver, the observation chamber 13 corresponds to the eye of the user, and the breath cavity 11 corresponds to the mouth and the nose of the user. When the user breathes, the external air flows into the breath cavity 11 through the inlet passage 21 and the observation chamber 13. Since the external fresh air flows all the way through the observation chamber 13, it can effectively prevent droplets from forming on the observation chamber 13, thus enabling the user to observe external environment more clearly. Further, an isolation band 110 is provided between the breath cavity 11 and the observation chamber 13, in other words, the mask 10 is divided into the breath cavity 11 and the observation chamber 13 by the isolation band 110, which is shaped to match the nose bridge of the user. The isolation band 110 is provided with a through hole 111, in which a third check valve 112 is provided. The third check valve 112 allows the air of the observation chamber 13 to flow into the breath cavity 11 through the through hole 111 and prevents the air of the breath cavity 11 from flowing back into the observation chamber 13 through the through hole 111, thus further preventing the air exhaled by the user to the breath cavity 11 from flowing back into the observation chamber 13, which may form droplets on the observation chamber 13 to obstruct the sight of the user. Meanwhile, the third check valve 112 can prevent the exhaust gas exhaled by the user from flowing from the observation chamber 13 back to the breath cavity 11, thereby effectively reducing the concentration of carbon dioxide in the breath cavity 11. In the illustrated embodiment, two through holes 111 are provided and spaced arranged, which can increase the amount of the air entering the breath cavity 11.

Specifically, the mask 10 includes a lens 14 located in front of the user's eyes, and a flexible skirt 15 closely fit with the face of the user, thus effectively ensuring air tightness and water tightness. The first exhaust passage 12 is formed by an outer side of the lens 14 and an inner side of the flexible skirt 15. Specifically, the outer side of the lens 14 is provided with an air groove 140. When the lens 14 is assembled with the flexible skirt 15, the inner side of the flexible skirt 15 seals the air groove 140 to form the first exhaust passage 12.

Further, the lens 14 includes an eyeglass portion 141 and an oral-nasal cover portion 142. The eyeglass portion 141 corresponds to the observation chamber 13 and can be made of a transparent resin material to facilitate observation of underwater scenery. In the illustrated embodiment, the eyeglass portion 141 has a substantially flat shape. The eyeglass portion 141 can be formed as a flat lens, a myopia lens, or a hyperopia lens. The oral-nasal cover portion 142 has a shape matching the mouth and the nose (including a chin) of the user. An edge of the oral-nasal cover portion 142 is provided with an exhaust hole 143 and an air through hole 144. The exhaust hole 143 communicates the first exhaust passage 12 and the breath cavity 11, such that the first exhaust passage 12 communicates the breath cavity 11 through the exhaust hole 143. When the exhaust device 30 stops working, the air exhaled to the breath cavity 11 by the user is discharged directly from the exhaust hole 143 into the first exhaust passage 12. It should be understood that the second check valve 120 is disposed at the exhaust hole 143. The air through hole 144 communicates the first exhaust passage 12 and the exhaust fan 31.

The flexible skirt 15 can be made of a soft material, such as silicone. Further, a bottom of the flexible skirt 15 is provided with an airflow portion 16 integrally formed with the flexible skirt 15. A first airflow passage 160 and a second airflow passage 161 are provided in the airflow portion 16. The first airflow passage 160 is located between the inlet passage 21 and the observation chamber 13, and the first airflow passage 160 communicates the inlet passage 21 and the observation chamber 13. In other words, the external air flows into the breath cavity 11 through the inlet passage 21, the first airflow passage 160, and the observation chamber 13. The second airflow passage 161 is located between the second exhaust passage 22 and the two first exhaust passages 12. The second airflow passage 161 communicates the first exhaust passages 12 and the second exhaust passage 22. In other words, the air in the breath cavity 11 is discharged to the external environment through the first exhaust passage 12, the second airflow passage 161, and the second exhaust passage 22.

It should be noted that both ends of the isolation band 110 are integrally formed with the flexible skirt 15. The edge of the isolation band 110 adjacent to the lens 14 can be firmly attached on the inner surface of the lens 14 by a pad fixing strip 113, thus effectively ensuring the air tightness between the breath cavity 11 and the observation chamber 13 at the edge of the isolation band 110.

In one of the embodiments, the mask 10 further includes a mask frame 17 connecting the lens 14 and the flexible skirt 15. The mask frame 17 is used to support the entire diving mask. The mask frame 17 is shaped to match the face of the user for better connecting with the lens 14 and the flexible skirt 15. A receiving tube 18 is provided at a top of the mask frame 17. The receiving tube 18 receives the airflow portion 16 and protects the airflow portion 16 from damage and leakage. The mask frame 17 is provided with a strap 19 for positioning the mask 10 on the head of the user.

Figure 3:
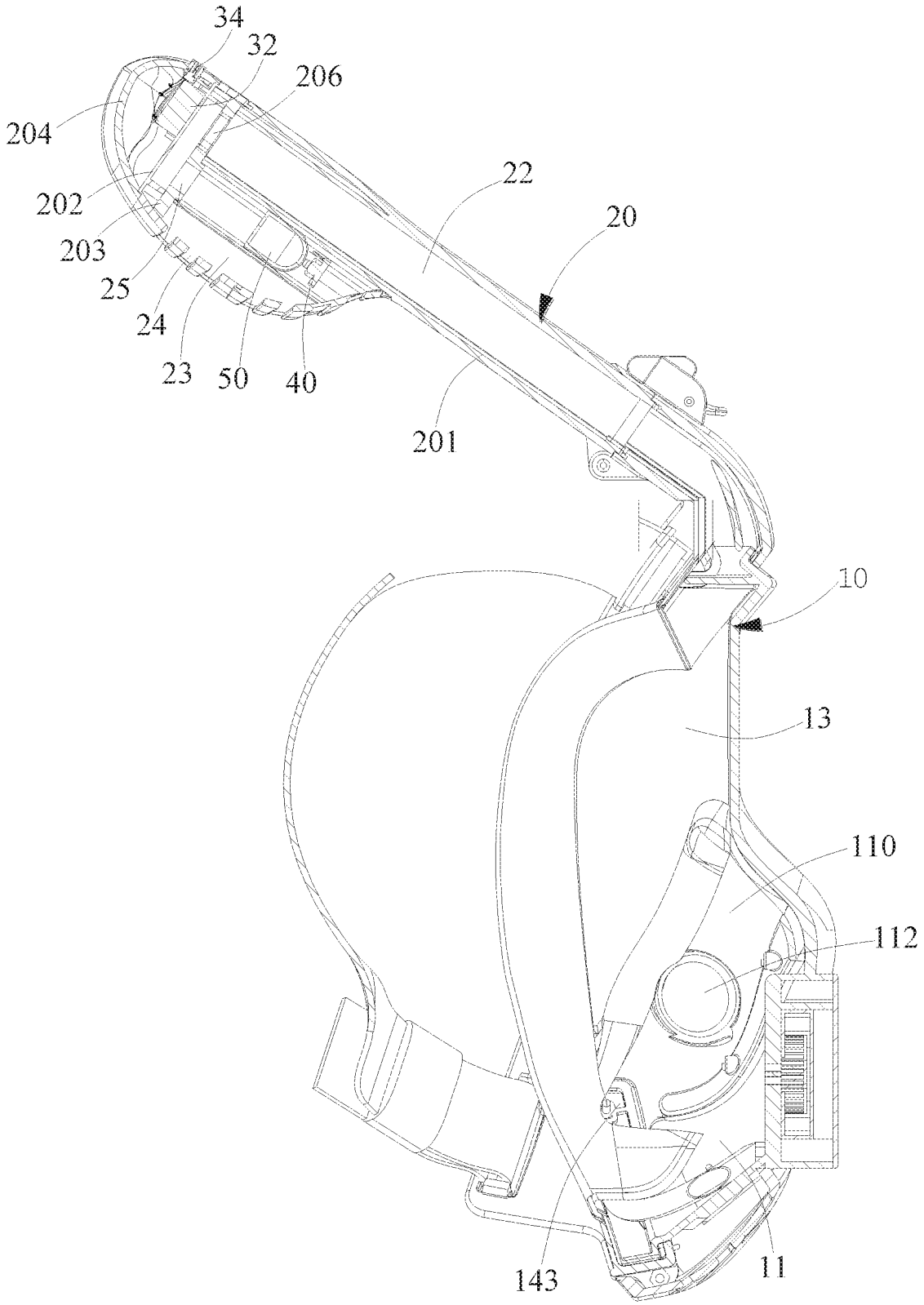
FIG. 3 is a cross-sectional view taken along A-A line of FIG. 1.
Figure 4:
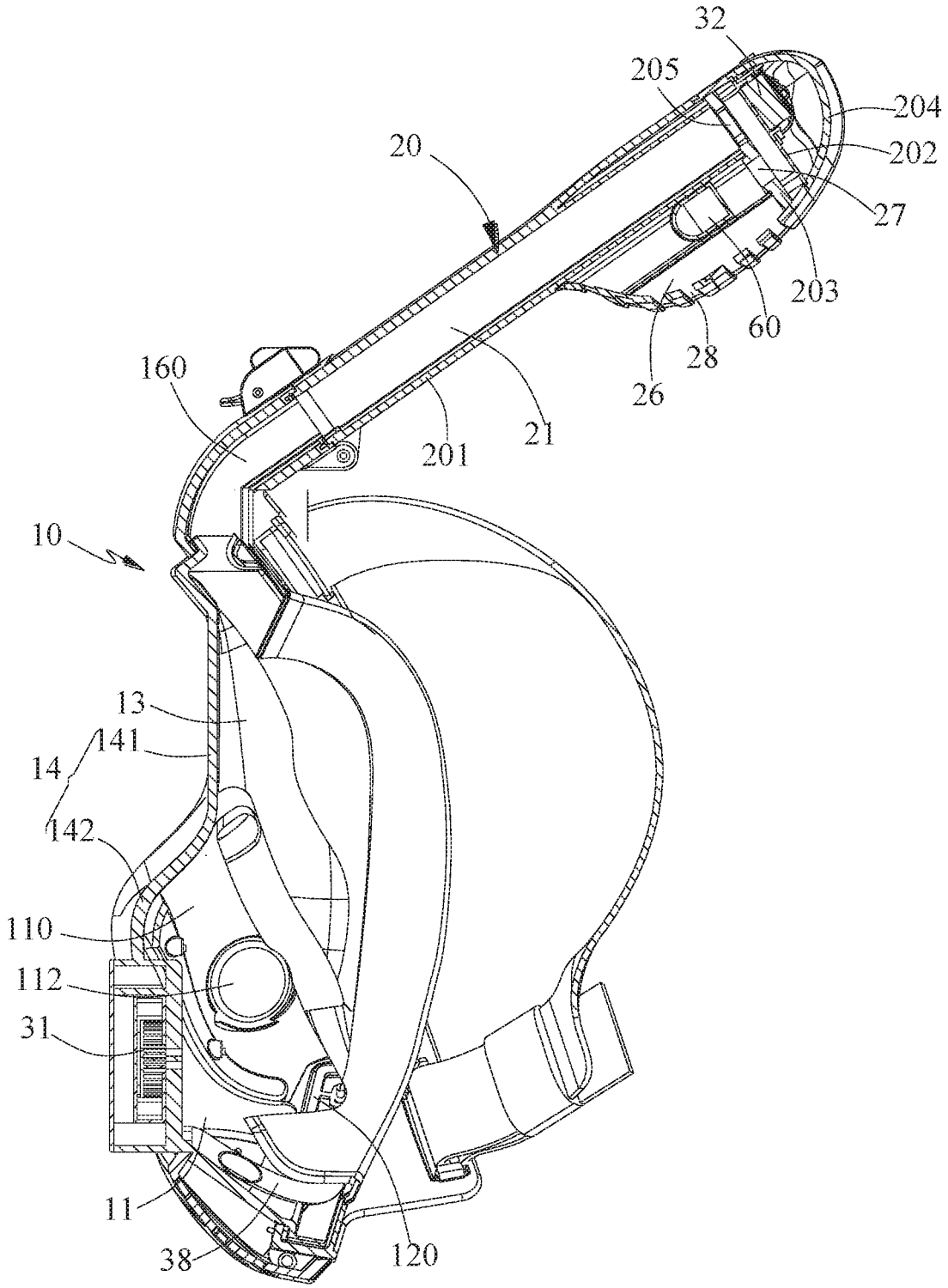
FIG. 4 is a cross-sectional view taken along B-B line of FIG. 1.

Referring to FIGS. 3 to 5, the diving mask further includes a detection switch 40 and a first buoyant valve body 50. The detection switch 40 is electrically coupled to the exhaust device 30. The detection switch 40 controls on/off of the exhaust device 30 in response to different positions of the first buoyant valve body 50. Specifically, the vent tube 20 is provided with a first accommodation chamber 23 located at an end thereof away from the mask 10. A side wall of the vent tube 20 is provided with a first vent hole 24 communicating the first accommodation chamber 23 and the external environment. The detection switch 40 is located at an end of the first accommodation chamber 23 adjacent to the mask 10. The first buoyant valve body 50 is accommodated in the first accommodation chamber 23. When the vent tube 20 is located above a water surface, the first buoyant valve body 50 presses the detection switch 40 down due to gravity, and the exhaust device 30 is then energized and starts to work. When the vent tube 20 is submerged into the water, the first buoyant valve body 50 is raised and moves away from the detection switch 40 by buoyancy. The detection switch 40 is switched off after the first buoyant valve body 50 stops pressing, and the exhaust device 30 is powered off and stop working.

Referring to FIGS. 3 and 5, the vent tube 20 is further provided with an outlet hole 25 communicating the first accommodation chamber 23 and the first exhaust passage 12. The first buoyant valve body 50 is located between the detection switch 40 and the outlet hole 25. When the vent tube 20 is located above the water surface, since there is no water in the first accommodation chamber 23 or the water entering the first accommodation chamber 23 from the first vent hole 24 is insufficient to float the first buoyant valve body 50, the first buoyant valve body 50 moves away from the outlet hole 25 due to gravity and presses the detection switch 40 to turn on the exhaust device 30. The exhaust fan 31 starts to work and discharges the air in the breath cavity 11 to the external environment through the first exhaust passage 12 and the second exhaust passage 22, and drives the external air into the breath cavity 11 through the inlet passage 21. When the vent tube 20 is submerged into the water, the water entering the first accommodation chamber 23 from the first vent hole 24 can float the first buoyant valve body 50. In other words, the first buoyant valve body 50 is raised by buoyancy and moves towards the outlet hole 25. Thus, after the first buoyant valve body 50 stops pressing the detection switch 40, the exhaust device 30 is turned off. And when the water in the first accommodation chamber 23 reaches a certain height, the first buoyant valve body 50 blocks the outlet hole 25 to prevent the water from flowing back into the breath cavity 11 through the first vent hole 24, the first accommodation chamber 23, the outlet hole 25, the second exhaust passage 22, the second airflow passage 161, and the first exhaust passage 12.

It should be noted that, when the inlet passage 21 is disconnected from the external air, if the exhaust fan 31 continues to discharge the air from the breath cavity 11 to the outside of the mask 10, a pressure difference will be generated between the air pressure in the breath cavity 11 and the atmospheric pressure, which may deform the face of the user and makes the user uncomfortable. Thus, the detection switch 40 and the first buoyant valve body 50 are introduced to ensure that the air pressure in the breath cavity 11 is balanced with the atmospheric pressure to effectively ensure the comfort of the user. The detection switch 40 controls the exhaust device 30 to be turned on and the exhaust fan 31 performs an exhaust operation when the inlet passage 21 communicates the external environment during the use of the diving mask. When the inlet passage 21 is disconnected from the external environment, the detection switch 40 controls the exhaust device 30 to be turned off and the exhaust fan 31 stops working. Meanwhile, by automatically controlling on/off of the exhaust device 30 through the detection switch 40, it is unnecessary for the user to operate, which brings great convenience to the user and improves the use's experience.

The vent tube 20 is rotatably connected to the mask 10 via a shaft. When the diving mask is not used, the vent tube 20 can be folded over the mask 10 to reduce the occupied space and facilitate carrying and storage. In the illustrated embodiment, the vent tube 20 is rotatably connected to the receiving tube 18 of the mask frame 17. In use, one end of the vent tube 20 is connected to the airflow portion 16, and the vent tube 20 is locked to the mask 10 by a locking means.

Referring to FIGS. 4 and 5, an end of the vent tube 20 away from the mask 10 is further provided with a second accommodation chamber 26, and an inlet hole 27 communicating the second accommodation chamber 26 and the inlet passage 21. The second accommodation chamber 26 and the first accommodation chamber 23 are spaced apart from each other. The side wall of the second accommodation chamber 26 is provided with a second vent hole 28 communicating the second accommodation chamber 26 and the external environment. The diving mask further includes a second buoyant valve body 60 accommodated in the second accommodation chamber 26 that is capable of blocking the inlet hole 27. It should be understood that, when the vent tube 20 is located above the water surface, there is no water in the first accommodation chamber 23 or insufficient water entering the first accommodation chamber 23 from the second vent hole 28 to float the second buoyant valve body 60. Thus, the second buoyant valve body 60 moves away from the inlet hole 27 due to gravity, and the inlet passage 21 is communicated with the external air. When the vent tube 20 is submerged into the water, the second buoyant valve body 60 is raised by buoyancy and blocks the inlet hole 27, and the inlet passage 21 is disconnected from the external air to prevent the water from flowing back into the breath cavity 11 through the second vent hole 28, the second accommodation chamber 26, the inlet hole 27, the inlet passage 21, and the first airflow passage 160.

Specifically, the vent tube 20 includes a tube body 201, a cover 202 provided at an end of the tube body 201 away from the mask 10, a gasket 203 located between the tube body 201 and the cover 202, and an end cap 204 provided on the cover 202. The first accommodation chamber 23 and the second accommodation chamber 26 are provided on the tube body 201. The outlet hole 25 and the inlet hole 27 are provided on the gasket 203. The gasket 203 is further provided with a first through hole 205 communicating the inlet passage 21 and a second through hole 206 communicating the second exhaust passage 22. In other words, the first accommodation chamber 23 communicates the second exhaust passage 22 through the outlet hole 25 and the second through hole 206. The second accommodation chamber 26 communicates the inlet passage 21 through the inlet hole 27 and the first through hole 205. The gasket 203 is generally made of a soft material, such as rubber or silicone. The gasket 203 is provided to ensure sealing when the first buoyant valve body 50 blocks the outlet hole 25 and the second buoyant valve body 60 blocks the inlet hole 27.

Referring again to FIGS. 3 to 5, the exhaust fan 31 is mounted on the mask 10. In the illustrated embodiment, the exhaust fan 31 is mounted on the mask 10 corresponding to the breath cavity 11. In other words, the exhaust fan 31 is mounted on the oral-nasal cover portion 142 of the lens 14. The exhaust fan 31 communicates the breath cavity 11 and the first exhaust passage 12. Specifically, the exhaust device 30 further includes an outlet tube 38, and both ends of the outlet tube 38 communicate the exhaust fan 31 and the first exhaust passage 12, respectively. The diving mask further includes a first check valve 145 mounted between the exhaust fan 31 and the first exhaust passage 12, in the first exhaust passage 12 or in the second exhaust passage 22. The first check valve 145 allows the air in the breath cavity 11 to flow into the exhaust fan 31, the first exhaust passage 12, and the second exhaust passage 22, sequentially, and prevents the air of the first exhaust passage 12 or the second exhaust passage 22 from flowing back to the breath cavity 11. It should be noted that when the first check valve 145 is mounted in the first exhaust passage 12 or the second exhaust passage 22, it can also prevent the air of the first exhaust passage 12 or the second exhaust passage 22 from flowing back into the breath cavity 11 through the exhaust hole 143, such that the second check valve 120 can be removed to save the production cost. In the illustrated embodiment, the first check valve 145 is mounted at a connection place where the outlet tube 38 communicates the first exhaust passage 12. In other embodiments, the first check valve 145 can also be mounted within the outlet tube 38.

It should be noted that the exhaust fan 31 can be connected to the lens 14 in a variety of ways, such as, the exhaust fan 31 can be latched on the lens 14, or the exhaust fan 31 can be connected to the lens 14 by screws, or the exhaust fan 31 is adhered to the lens 14 by adhesive.

It should be understood that, in other embodiments, the exhaust fan 31 can also be mounted at other places, as long as the exhaust fan 31 connects to the breath cavity 11 and the first exhaust passage 12, respectively, or the exhaust fan 31 connects to the breath cavity 11 and the second exhaust passage 22, respectively, or the exhaust fan 31 can be mounted in the first exhaust passage 12 or in the second exhaust passage 22. As long as the exhaust fan 31 is placed on the exhaust path between the breath cavity 11 and the external environment, it can actively exhaust the air from the breath cavity 11 to the external environment.

The exhaust device 30 further includes a battery 32 and a PCB 33, which are mounted in the vent tube 20. Further, the battery 32 and the PCB 33 are mounted in an end of the vent tube 20 away from the mask 10. An accommodation space is formed between the end cap 204 and the cover 202, the battery 32 and the PCB 33 are mounted in the accommodation space. The PCB 33 is electrically coupled to the exhaust fan 31, the battery 32, and the detection switch 40. Further, the exhaust fan 31 is connected to the PCB 33 through a wire which in turn passes through the breath cavity 11, the first exhaust passage 12, the second exhaust passage 22, and the accommodation space.

Figure 6:
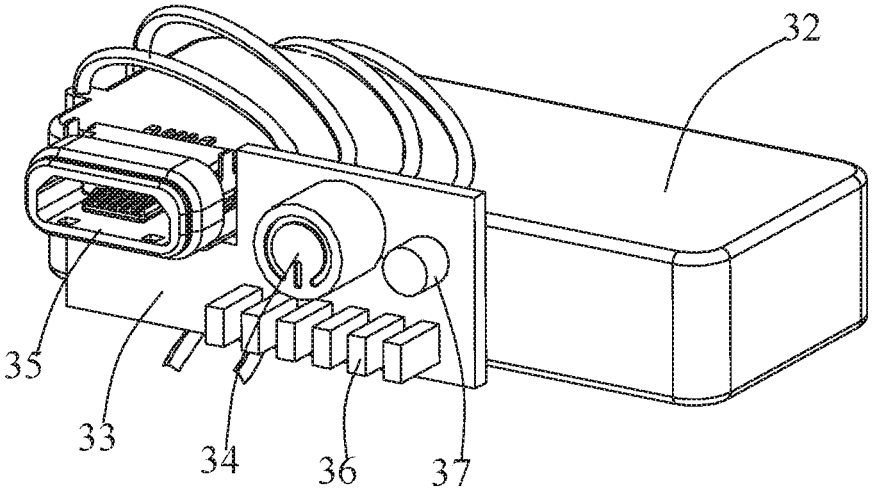
FIG. 6 is a perspective view of partial exhaust device of FIG. 5.

Referring to FIG. 6, the PCB 33 is further provided with a power switch 34, a charging interface 35, a battery indicator 36, and a battery alarm 37. The power switch 34, the charging interface 35, and the battery indicator 36 are exposed to the vent tube 20. The power switch 34 is also used to control on/off of the exhaust fan 31. In other words, the user can control on/off of the exhaust fan 31 by operating the power switch 34. The battery indicator 36 is configured to display a status of the battery 32, and the battery alarm 37 is configured to sound an alarm when the battery 32 is low.

Figure 7:
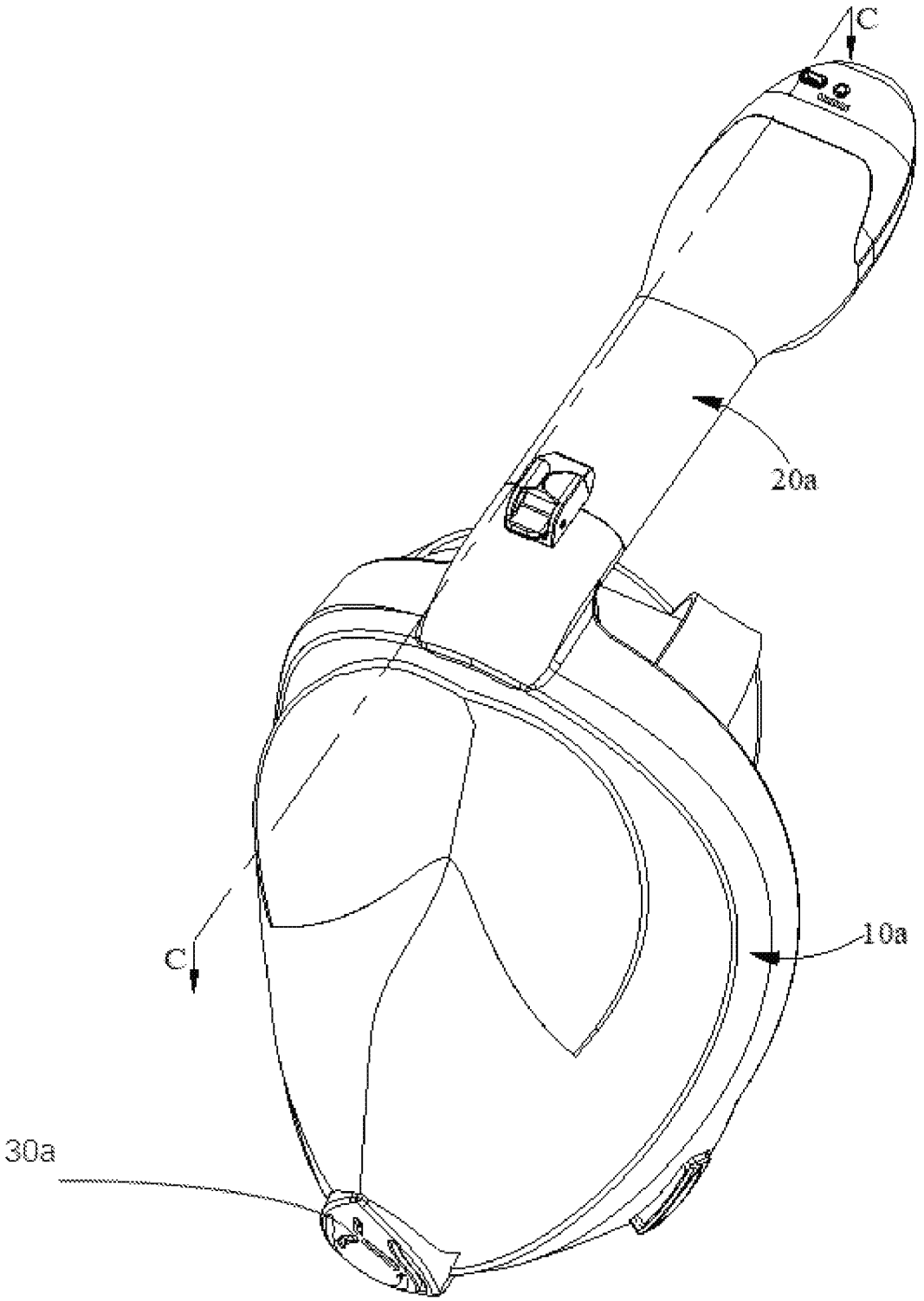
FIG. 7 is a perspective view of a diving mask according to a second embodiment.
Figure 8:
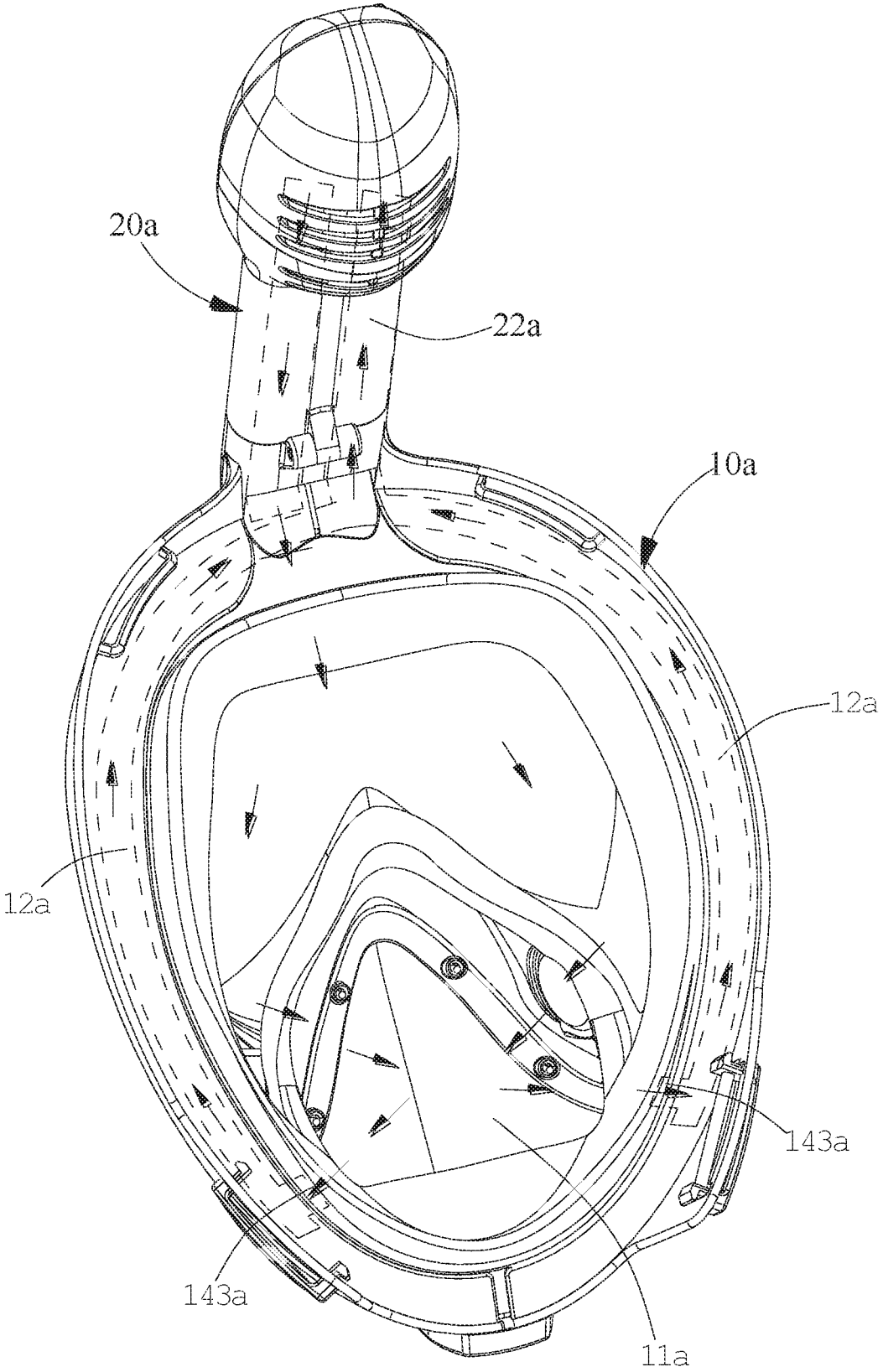
FIG. 8 is a perspective view of the diving mask of FIG. 7 viewed from another aspect after removing the strap.
Figure 9:
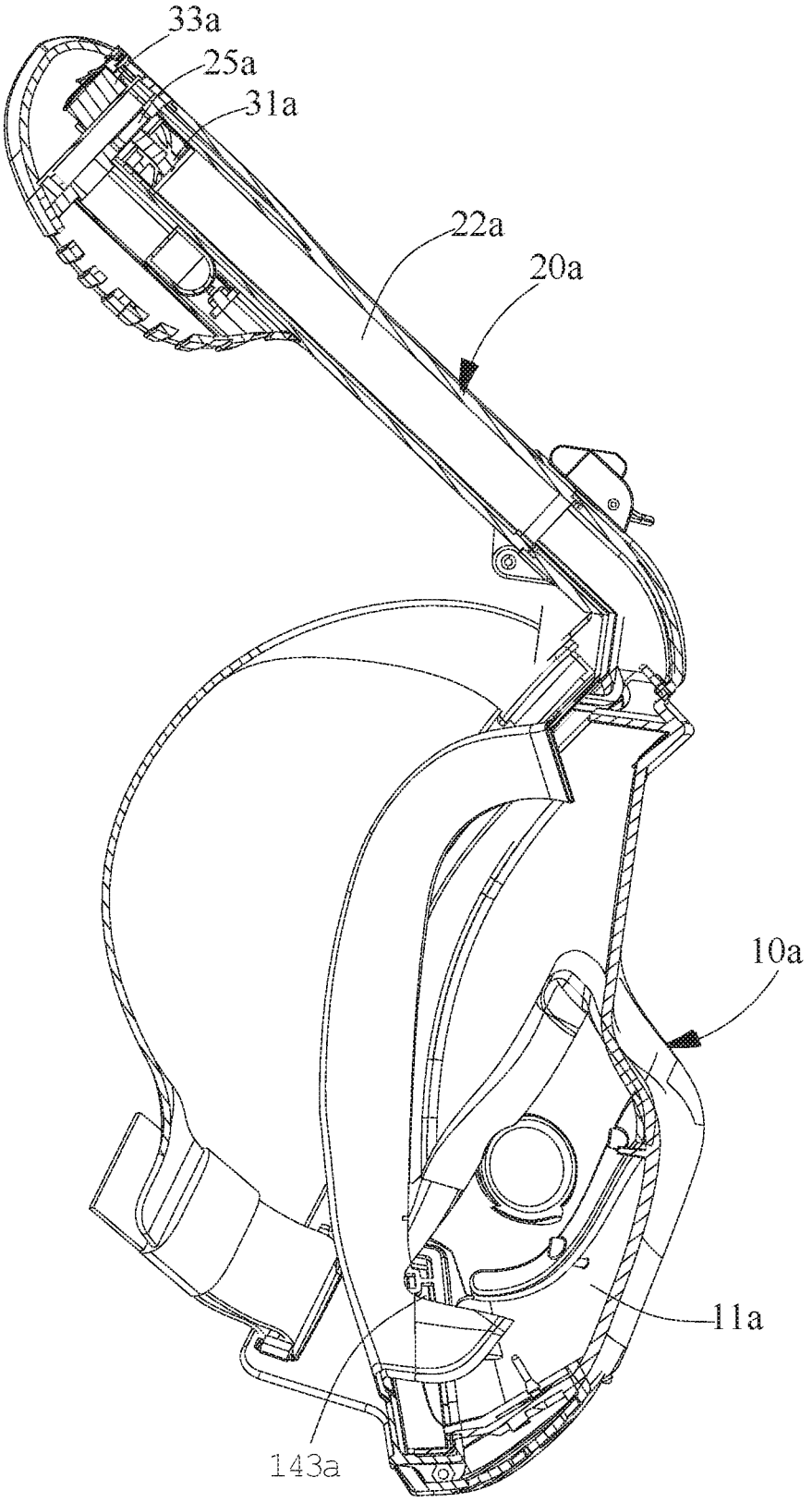
FIG. 9 is a cross-sectional view taken along B-B line of FIG. 7.

Referring to FIGS. 7 to 9, a diving mask according to a second embodiment includes a mask 10*a*, a vent tube 20*a* connected to the mask 10*a*, and an exhaust device 30*a*. The mask 10*a*, the vent tube 20*a*, and the exhaust device 30*a* of the second embodiment are similar to the mask 10, the vent tube 20, and the exhaust device 30*a* of the first embodiment, respectively. The difference is that the exhaust fan 31*a* of the exhaust device 30*a* is mounted in the second exhaust passage 22*a*. Further, the exhaust fan 31*a* is mounted at one end of the second exhaust passage 22*a* away from the mask 10*a*, in other words, the exhaust fan 31*a* is disposed adjacent to an outlet hole 25*a*, thereby reducing the length of the wire between the exhaust fan 31*a* and the PCB 33*a*. When the exhaust device 30*a* starts to work, the exhaust fan 31*a* can discharge the exhaust gas exhaled to the breath cavity 11*a* to the external environment through the exhaust hole 143*a*, the first exhaust passage 12*a*, and the second exhaust passage 22*a*. It should be noted that, in other embodiments, the exhaust fan 31*a* of the exhaust device 30*a* can also be mounted in the first exhaust passage 12*a*.

Figure 10:
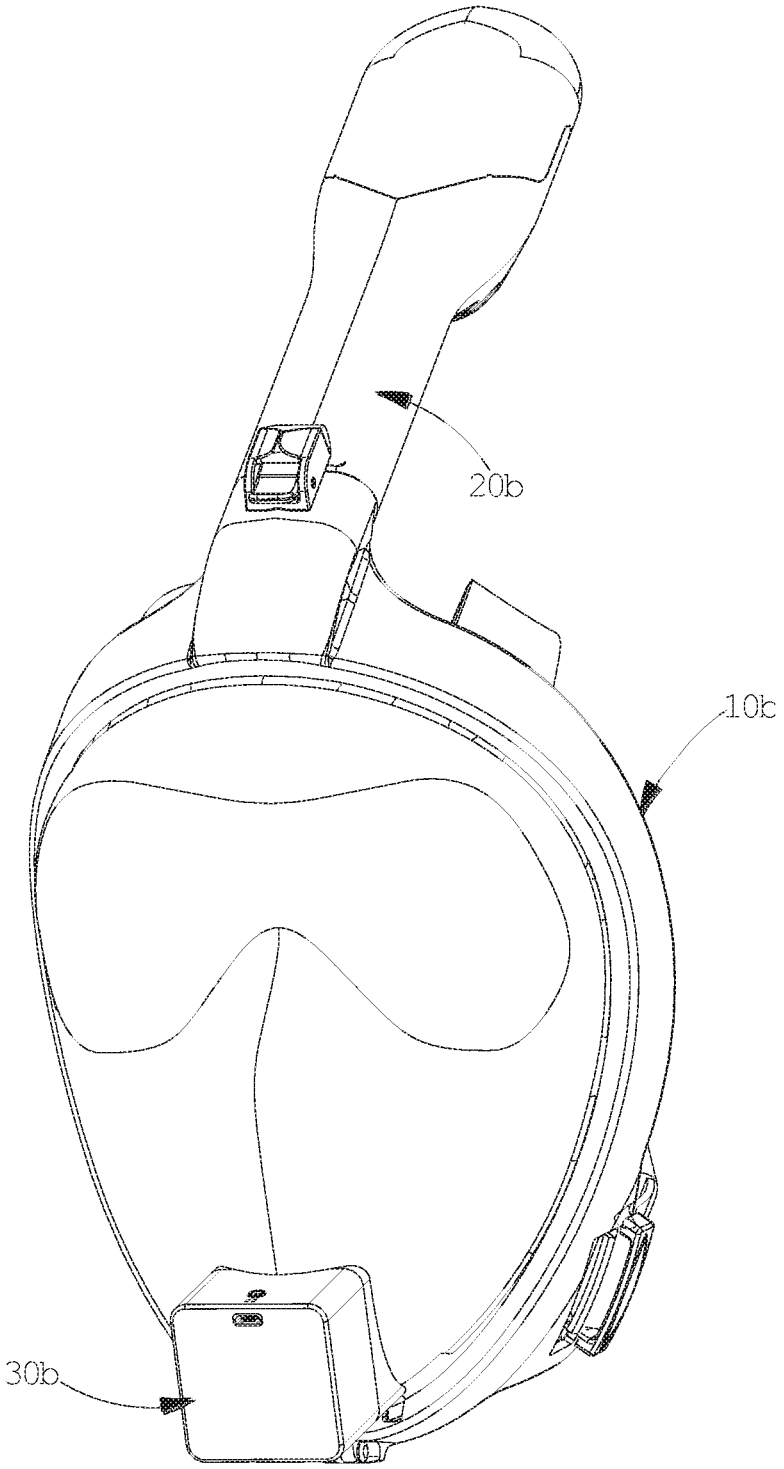
FIG. 10 is a perspective view of a diving mask according to a third embodiment.
Figure 11:
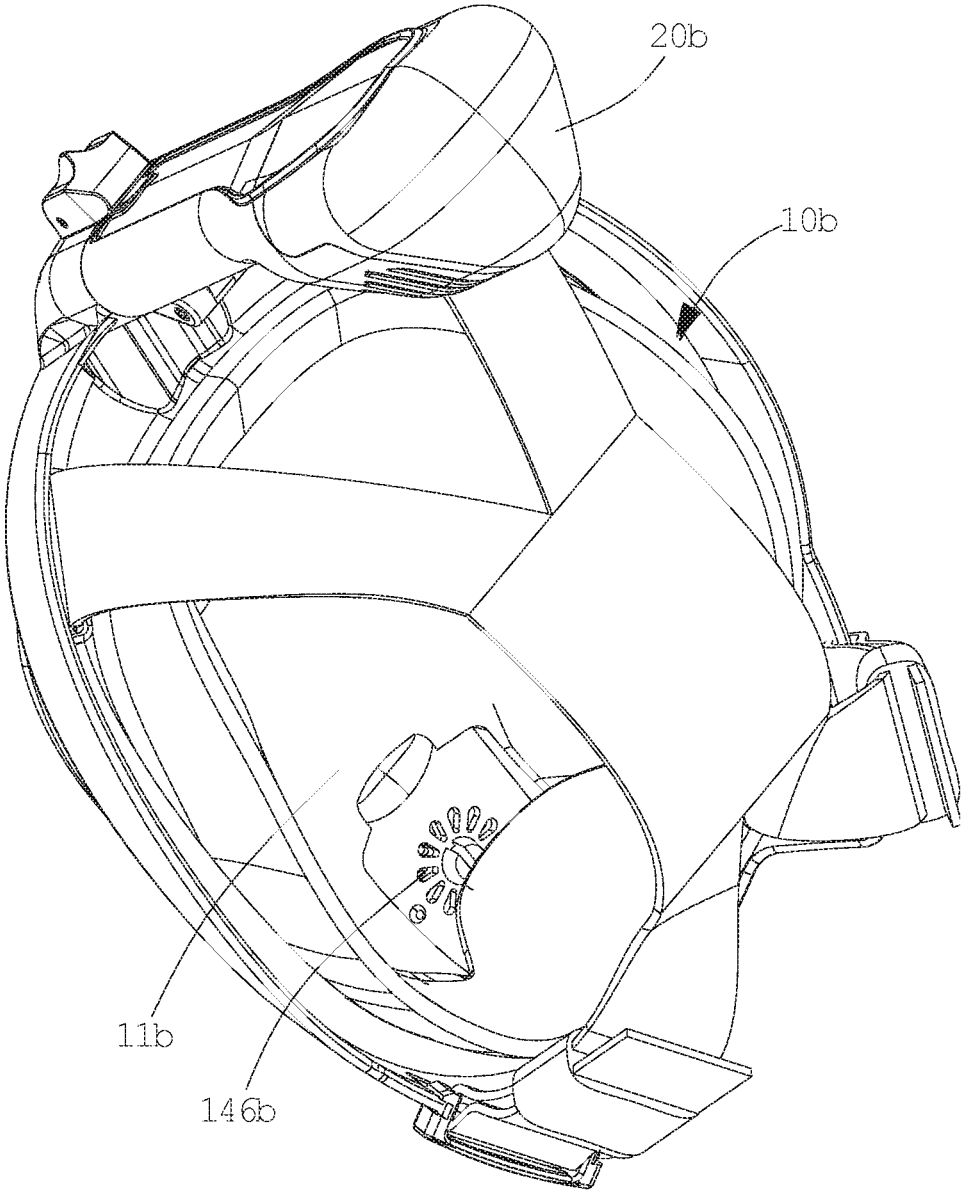
FIG. 11 is a perspective view of the diving mask of FIG. 10 viewed from another aspect.
Figure 12:
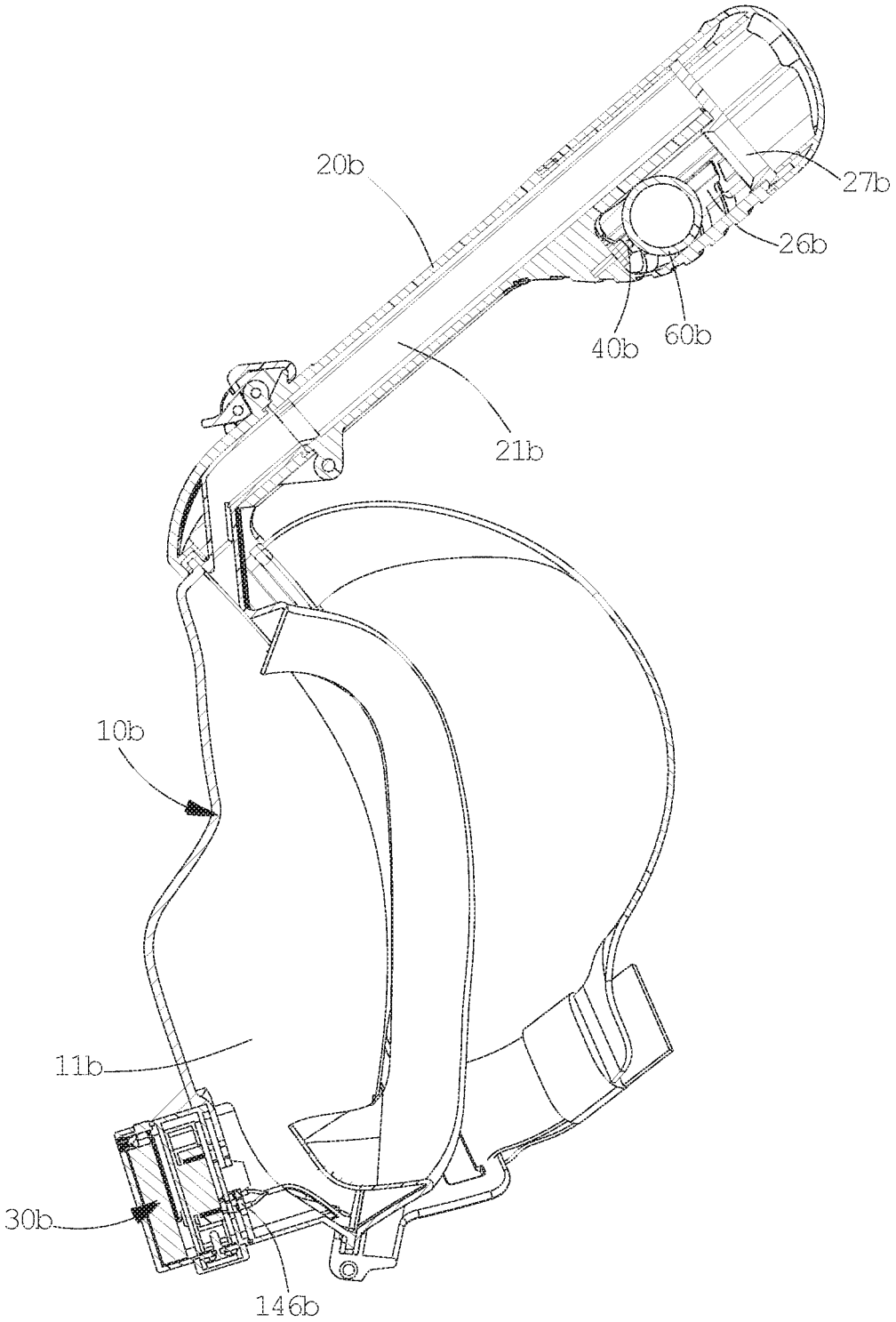
FIG. 12 is a cross-sectional view of the diving mask of FIG. 10.

Referring to FIGS. 10 to 12, a diving mask according to a third embodiment includes a mask 10*b*, a vent tube 20*b* connected to the mask 10*b*, an exhaust device 30*b*, a detection switch 40*b*, and a second buoyant valve body 60*b*. The detection switch 40*b* and the second buoyant valve body 60*b* of the third embodiment are the same as the detection switch 40 and the second buoyant valve body 60 of the first embodiment, respectively. The difference is that the vent tube 20*b* is provided with only the inlet passage 21*b*, the exhaust device 30*b* is mounted on the outside of the mask 10*b*, and the exhaust device 30*b* communicates the breath cavity 11*b* and the external environment. In other words, the exhaust device 30*b* directly discharge the air to the external environment without the passage in the mask 10*b*. When the mask 10*b* is in the water, the exhaust device 30*b* discharges the air in the breath cavity 11*b* into the water. Further, the mask 10*b* is provided with a plurality of slots 146*b* corresponding to the breath cavity 11*b*, and the plurality of slots 146*b* communicate the breath cavity 11*b* and the exhaust device 30*b*. The exhaust device 30*b* is provided corresponding to the plurality of slots 146*b*. Thus, in use, external air flows into the breath cavity 11*b* through the inlet passage

21*b*, and the exhaust device 30*b* discharges the exhaust gas in the breath cavity 11*b* to the water directly from the plurality of slots 146*b*.

In the illustrated embodiment, the exhaust device 30*b* is detachably mounted on the mask 10*b* such that when maintenance or charging of the exhaust device 30*b* is required, the exhaust device 30*b* can be detached from the mask 10*b*, thus it is convenient to use. The exhaust device 30*b* is mounted on the outer surface of the mask 10*b*, in other words, the exhaust device 30*b* is mounted on the mask 10*b* facing away from the breath cavity 11*b* to facilitate maintenance and disassembly of the exhaust device 30*b*. Meanwhile, it is advantageous to reduce the space in the breath cavity 11*b*, such that more fresh air can be accommodated in the breath cavity 11*b*, and the user can breathe more smoothly.

The detection switch 40*b* is provided in the second accommodation chamber 26*b*, and the detection switch 40*b* is electrically coupled to the exhaust device 30*b*. The second buoyant valve body 60*b* is accommodated in the second accommodation chamber 26*b* and is located between the detection switch 40*b* and the inlet hole 27*b*. During the diving process with the diving mask, when the vent tube 20*b* is located above the water surface, the second buoyant valve body 60*b* move away from the inlet hole 27*b* due to gravity. And the second buoyant valve body 60*b* presses the detection switch 40*b* to activate the exhaust device 30*b*. The exhaust device 30*b* discharges the air in the breath cavity 11*b* to the outside of the mask 10*b*, and drives the external air into the breath cavity 11*b* through the inlet passage 21*b*. When the vent tube 20*b* is submerged into the water, the second buoyant valve body 60*b* is raised by buoyancy and moves towards the inlet hole 27*b*. After the second buoyant valve body 60*b* stops pressing the detection switch 40*b*, the exhaust device 30*b* stops working.

The various technical features of the above-described embodiments can be arbitrarily combined, and for the sake of brevity, all possible combinations of the various technical features in the above-described embodiments are not described. However, as long as there is no contradiction in the combination of these technical features, it should be deemed to be within the scope of this specification.

The above-described embodiments represent only several embodiments of the disclosure. The description of the embodiments is more specific and detailed, but are not therefore to be construed as limiting the scope of the disclosure patent. It should be noted that several modifications and improvements can be made to those of ordinary skill in the art without departing from the inventive concept, all of the modifications and improvements fall within the scope of the disclosure. Therefore, the scope of protection of the disclosure patent shall be subject to the appended claims.

What is claimed is:

1. A diving mask, comprising:

a mask having a breath cavity configured to correspond to a mouth and a nose of a user;

a vent tube connected to the mask and provided with an inlet passage, the breath cavity fluidly connected to an external environment via the inlet passage; and an exhaust device fluidly connected to the breath cavity, the exhaust device comprising an exhaust fan configured to discharge air in the breath cavity into the external environment, thereby enabling external air to flow into the breath cavity through the inlet passage;

wherein the mask is provided with a first exhaust passage fluidly connected to the exhaust fan, and the vent tube is provided with a second exhaust passage fluidly connected to the first exhaust passage and the external environment; and wherein the mask further comprises a first check valve mounted between the exhaust fan and the first exhaust passage, in the first exhaust passage, or in the second exhaust passage, wherein the first check valve allows air in the breath cavity to flow into the exhaust fan, the first exhaust passage, and the second exhaust passage, sequentially, and prevents the air of the first exhaust passage or the second exhaust passage from flowing back to the breath cavity.

2. The diving mask of claim 1, further comprising a battery and a printed circuit board (PCB) electrically coupled to the exhaust fan and the battery, wherein the PCB is further provided with a power switch configured to control on/off of the exhaust fan, a charging interface configured to charge the battery, a battery indicator configured to display a status of the battery, and a battery alarm configured to sound an alarm when the battery is low.

3. The diving mask of claim 1, wherein the exhaust fan is mounted in the second exhaust passage.

4. The diving mask of claim 1, wherein the exhaust fan is mounted on the mask, the exhaust device further comprising an outlet tube, both ends of the outlet tube fluidly connected to the exhaust fan and the first exhaust passage, respectively.

5. The diving mask of claim 1, further comprising a second check valve provided at a connection place between the first exhaust passage and the breath cavity, wherein the second check valve allows the air in the breath cavity to flow into the first exhaust passage, and prevents the air of the first exhaust passage from flowing back into the breath cavity.

6. The diving mask of claim 5, wherein the mask comprises a lens configured to be located in front of the user's eyes, the lens comprises an oral-nasal cover portion corresponding to the breath cavity, an edge of the oral-nasal cover portion being provided with an exhaust hole and an air through hole, the first exhaust passage fluidly connected to the breath cavity through the exhaust hole, the second check valve being disposed at the exhaust hole, the first exhaust passage fluidly connected to the exhaust fan via the air through hole.

7. The diving mask of claim 1, further comprising an observation chamber located between the inlet passage and the breath cavity, an isolation band having a through hole being provided between the breath cavity and the observation chamber, the diving mask further comprising a third check valve located in the through hole, wherein the third check valve allows the air of the observation chamber to flow into the breath cavity through the through hole, and prevents the air of the breath cavity from flowing back into the observation chamber through the through hole.

8. The diving mask according to claim 1, further comprising a detection switch and a first buoyant valve body, wherein the detection switch is electrically coupled to the exhaust device, the detection switch is configured to control on/off of the exhaust device in response to different positions of the first buoyant valve body.

9. The diving mask of claim 8, wherein the vent tube is provided with a first accommodation chamber, a side wall of the vent tube being provided with a first vent hole fluidly connected to the first accommodation chamber and the external air, the detection switch being located at an end of the first accommodation chamber adjacent to the mask, the first buoyant valve body being accommodated in the first accommodation chamber.

10. The diving mask of claim 9, wherein the first accommodation chamber is located at an end of the vent tube away from the mask, the vent tube being provided with an outlet hole fluidly connected to the first accommodation chamber and the second exhaust passage, the first buoyant valve body being located between the detection switch and the outlet hole;

wherein when the vent tube is located above a water surface, the first buoyant valve body moves away from the outlet hole due to gravity, and presses the detection switch to activate the exhaust device; and when the vent tube is submerged into the water, the first buoyant valve body is raised by buoyancy and moves towards the outlet hole, and the exhaust device is deactivated after the first buoyant valve body stops pressing the detection switch.

11. The diving mask of claim 10, wherein an end of the vent tube away from the mask is further provided with a second accommodation chamber, and an inlet hole fluidly connected to the second accommodation chamber and the inlet passage, the second accommodation chamber and the first accommodation chamber being spaced apart from each other, a side wall of the second accommodation chamber being provided with a second vent hole fluidly connected to the second accommodation chamber, the second vent hole being fluidly connected to the external air, the diving mask further comprising a second buoyant valve body accommodated in the second accommodation chamber and being capable of blocking the inlet hole;

wherein when the vent tube is located above the water surface, the second buoyant valve body moves away from the inlet hole due to gravity, and the inlet passage being communicated with the external air; and when the vent tube is submerged into the water, the second buoyant valve body is raised by buoyancy and blocks the inlet hole, and the inlet passage is disconnected from the external air to prevent the water from flowing back into the breath cavity through the second vent hole, the second accommodation chamber, the inlet hole, the inlet passage, and a first airflow passage.

12. The diving mask of claim 1, wherein the mask comprises a lens configured to be located in front of the user's eyes and a flexible skirt configured to closely fit with the face of the user.

13. The diving mask of claim 12, wherein the first exhaust passage is formed by an outer side edge of the lens and an inner side edge of the flexible skirt.

14. The diving mask of claim 12, wherein the flexible skirt is provided with an airflow portion having a first airflow passage and a second airflow passage, the first airflow passage fluidly connected to the inlet passage and an observation chamber, the first exhaust passage fluidly connected to the second exhaust passage via the second airflow passage.

15. The diving mask of claim 12, wherein the diving mask further comprises a mask frame connecting the lens and the flexible skirt, the mask frame being shaped to match a face of the user.

16. The diving mask of claim 1, wherein the vent tube comprises a tube body, a cover located at an end of the tube body away from the mask, a gasket located between the tube body and the cover, and an end cap provided on the cover.

17. A diving mask, comprising:

a mask having a breath cavity configured to correspond to a mouth and a nose of a user;

a vent tube connected to the mask and provided with an inlet passage, the breath cavity fluidly connected to an external environment via the inlet passage; and an exhaust device fluidly connected to the breath cavity, the exhaust device comprising an exhaust fan configured to discharge air in the breath cavity into the external environment, thereby enabling external air to flow into the breath cavity through the inlet passage;

wherein the mask is provided with a first exhaust passage fluidly connected to the exhaust fan, and the vent tube is provided with a second exhaust passage fluidly connected to the first exhaust passage and the external environment; and wherein the exhaust fan is mounted on the mask, the exhaust device further comprises an outlet tube, and both ends of the outlet tube are fluidly connected to the exhaust fan and the first exhaust passage, respectively.

18. A diving mask comprising:

a mask having a breath cavity configured to correspond to a mouth and a nose of a user;

a vent tube connected to the mask and provided with an inlet passage, the breath cavity fluidly connected to an external environment via the inlet passage; and an exhaust device fluidly connected to the breath cavity, the exhaust device comprising an exhaust fan configured to discharge air in the breath cavity into the external environment, thereby enabling external air to flow into the breath cavity through the inlet passage;

wherein the mask is provided with a first exhaust passage fluidly connected to the exhaust fan, and the vent tube is provided with a second exhaust passage fluidly connected to the first exhaust passage and the external environment;

wherein the mask further comprises a detection switch and a first buoyant valve body; and wherein the detection switch is electrically coupled to the exhaust device and configured to control on/off of the exhaust device in response to different positions of the first buoyant valve body.

19. The diving mask of claim 18, wherein the vent tube is provided with a first accommodation chamber, a side wall of the vent tube being provided with a first vent hole fluidly connected to the first accommodation chamber and the external air, the detection switch being located at an end of the first accommodation chamber adjacent to the mask, the first buoyant valve body being accommodated in the first accommodation chamber.

* * * * *